US005088525A

United States Patent [19]

Zimmermann

[11] Patent Number: 5,088,525

[45] Date of Patent: Feb. 18, 1992

[54] REED BEAM CONSTRUCTION WITH ADJUSTABLE GRIPPER ROD GUIDE SURFACES

[75] Inventor: Ewald Zimmermann, Meerbusch, Fed. Rep. of Germany

[73] Assignee: Lindauer Dornier GmbH, Lindau, Fed. Rep. of Germany

[21] Appl. No.: 632,157

[22] Filed: Dec. 21, 1990

[30] Foreign Application Priority Data

Jan. 12, 1990 [DE] Fed. Rep. of Germany ..... 4000686

[51] Int. Cl.[5] ..... D03D 47/18; D03D 49/60

[52] U.S. Cl. ..... 139/188 R; 139/192; 139/446; 139/449

[58] Field of Search ..... 52/243, 737, 739, 740, 52/735; 139/192, 446, 188 R, 449

[56] References Cited

U.S. PATENT DOCUMENTS 1,094,841 4/1914 Ellinger ..... 52/737 X
2,538,630 1/1951 Rusnov ..... 139/188 R
3,842,869 10/1974 Champagne ..... 139/188 R
4,080,771 3/1978 Weller ..... 52/92 X
4,638,839 1/1987 Pezzoli ..... 139/188 R

FOREIGN PATENT DOCUMENTS 0402285 12/1990 European Pat. Off. ..... 139/446

*Primary Examiner*—Andrew M. Falik
*Attorney, Agent, or Firm*—W. G. Fasse

[57] ABSTRACT

A gripper loom is equipped along its reed or slay beam with a plurality of compartments formed by separation walls extending in parallel to each other and in parallel to the lower shed forming warp threads which pass through these compartments. The upper edges of the separation walls are aligned with each other and with a guide surface of the gripper rods so that the upper edges form extension guide surfaces for the gripper rods. Thus, the lower shed forming warp threads do not interfere with the proper motion of the gripper rods.

7 Claims, 2 Drawing Sheets

FIG. 2a
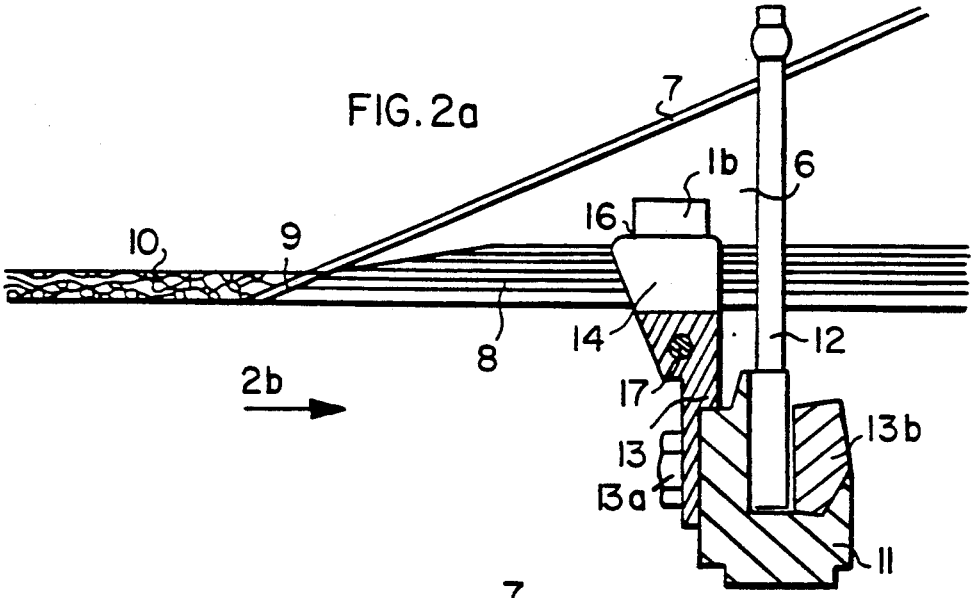
FIG. 2b
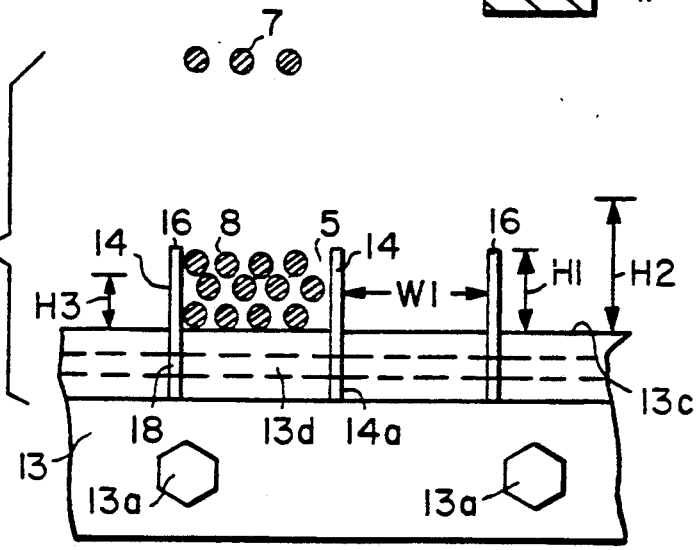
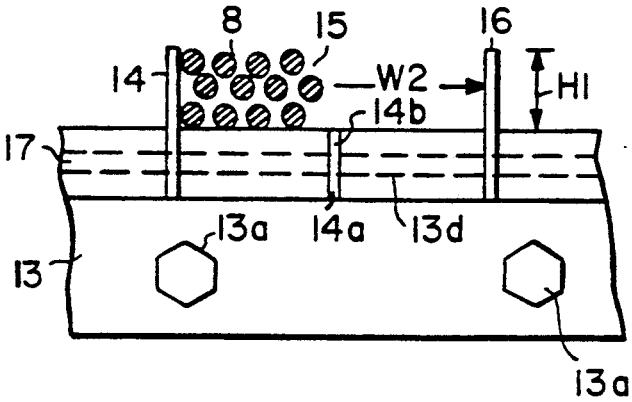
FIG. 3

REED BEAM CONSTRUCTION WITH ADJUSTABLE GRIPPER ROD GUIDE SURFACES

FIELD OF THE INVENTION

The invention relates to a reed beam construction for a gripper loom for weaving heavy duty fabrics. Fabrics of this type are, for example, used to make conveyor belts, including conveyor belts for operation in mines.

BACKGROUND INFORMATION

Gripper looms comprise two grippers carried by gripper rods arranged one on each side of the loom to move into and out of the loom shed. One gripper carries the weft thread halfway into the loom shed while the other gripper seizes the thread and pulls it entirely through the loom shed. The movement of the gripper rods into and out of the loom shed takes place freely along a so-called slay sole formed by the reed beam. Thus, the gripper rods must pass over the lower shed warp threads. The lower shed warp threads also pass along the slay sole, but crosswise thereto while the gripper rod passes lengthwise along the slay sole. If the lower shed warp threads are very heavy as is necessary for heavy duty industrial fabrics, they have a tendency to displace the gripper rod upwardly away from a straight linear course. Since these heavy duty fabrics can have a thickness of up to 15 mm, the deflection of the gripper rods can become severe and the proper operation of the loom is no longer assured. Especially the proper transfer of the weft thread from one gripper head to the other is not assured due to the deflection of the gripper rods.

OBJECTS AND SUMMARY OF THE INVENTION

In view of the foregoing it is the aim of the invention to achieve the following objects singly or in combination:

to improve the reed beam construction for a gripper loom for heavy duty fabrics in such a way that the free and linear movement of the gripper rods is assured throughout the width of the loom shed regardless of the type of warp threads that form the lower shed;

to provide a guiding surface for the gripper rods above the slay sole; and to provide compartments on the slay sole through which the lower shed warp threads can pass.

The foregoing objects are achieved according to the invention by separation walls secured to the slay sole or reed beam with spacings between the separation walls so that compartments are formed which have such an axial width and vertical depth that all the lower shed warp threads can pass through these compartments, without interfering with the gripper movements.

The upper edges of the separation walls are aligned with a guide surface of a gripper rod guide member and thus these edges form an extension of the guide surface for the gripper rods into and out of the loom shed. By providing the compartments for the lower shed warp threads it is assured that the threads can no longer deflect the movement direction of the gripper rods because all the threads are now located below the level of the upper edges of the separation walls. Thus, any contact of the gripper heads and of the gripper rods with the warp threads forming the lower shed is avoided. Accordingly, the gripper rods can now move on a linear path back and forth to the center of the loom shed.

It has been found that the upper edges of the separation walls form a proper guiding surface, even though these edges are spaced from each other. The edges extend in parallel to each other and in parallel to the movement direction of the warp threads forming the lower shed. The separation walls do not yield in an elastic or springy manner so that the gripper rods are solidy supported and are prevented from yielding in an elastic manner, thereby assuring a proper gripper rod movement.

Preferably, the separation walls are rigidly, but exchangeably secured to the reed beam or the slay sole. The dimensions of the separation walls vertically above the slay sole are selected with regard to the thickness of the fabric to be produced. By exchanging one set of separation walls against another set with different vertical dimensions, the loom is easily adapted to weaving fabrics of different thicknesses that may range up to about 15 mm and more. It has been found that a separation wall height of 11 mm is sufficient for a heavy duty fabric thickness of 15 mm. In any event, the compartments formed by the separation walls will be so dimensioned that all warp threads forming the lower shed will be accommodated in these compartments so that all heavy duty fabrics can be woven on looms equipped according to the invention.

BRIEF DESCRIPTION OF THE DRAWINGS

In order that the invention may be clearly understood, it will now be described, by way of example, with reference to the accompanying drawings, wherein:

FIG. 2*a* illustrates a vertical section through the reed beam according to the invention perpendicularly to the movement direction of the gripper rod;

FIG. 2*b* shows a view onto the reed beam according to the invention in the direction of the warp threads forming the lower shed as indicated by the arrow 2*b* in FIG. 2*a*; and FIG. 3 is a view similar to that of FIG. 2*b* for illustrating a wider compartment for the lower shed warp threads.

Figure 1:
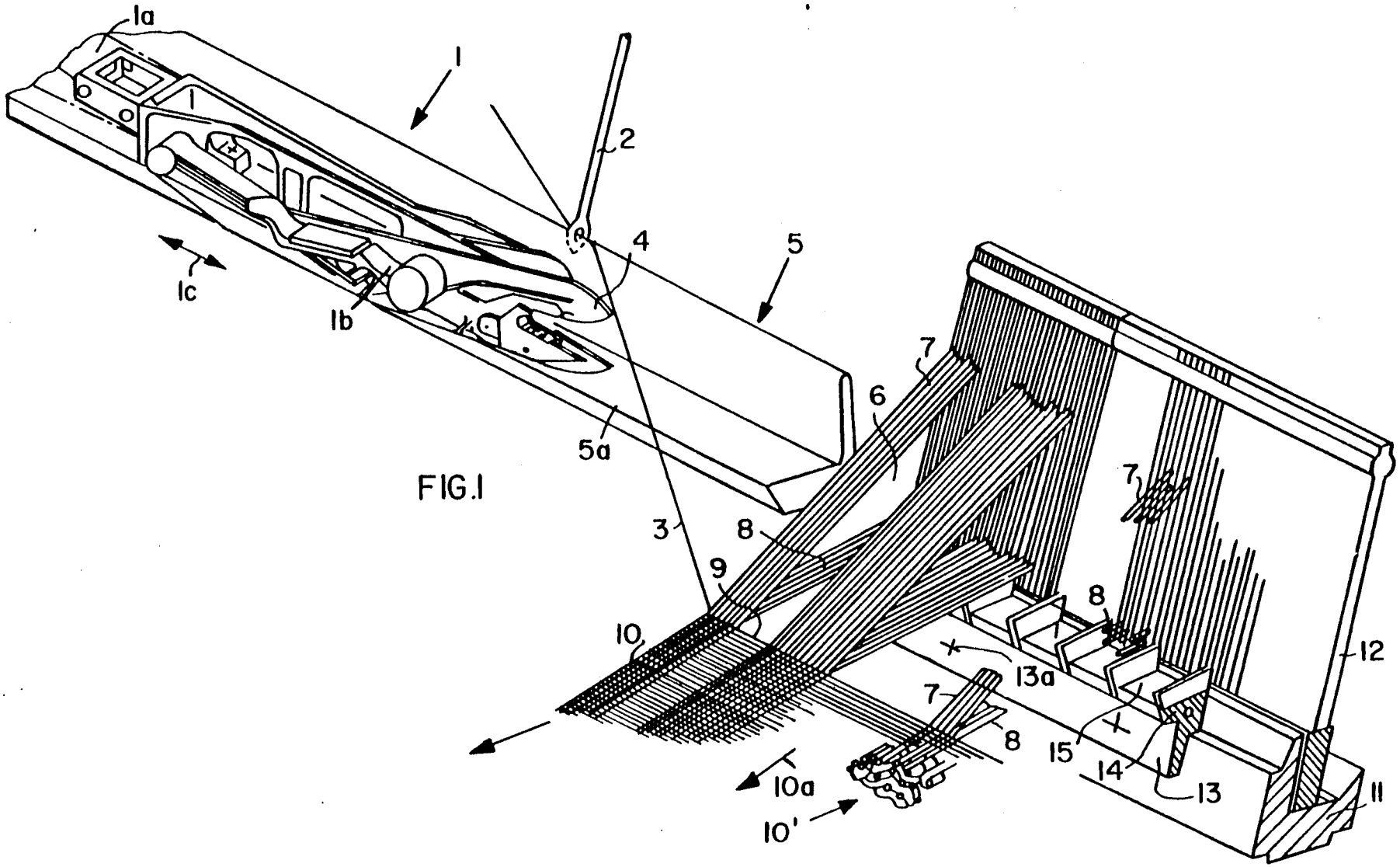
FIG. 1 is a perspective view of a portion of the reed beam with the slay sole equipped according to the invention.

DETAILED DESCRIPTION OF PREFERRED EXAMPLE EMBODIMENTS AND OF THE BEST MODE OF THE INVENTION

FIG. 1 illustrates a perspective view of a portion of an improved reed beam 11 according to the invention. A gripper assembly 1 having a gripper rod la carrying a gripper head 1*b* with a gripper clamp 4 travels back and forth as indicated by the arrow 1*c* on a guide surface 5*a* formed by a gripper rod guide 5. A weft thread 3 is presented by a thread guide needle 2 to the gripper clamp 4. As shown, the gripper head 1*b* is ready to seize with its clamp 4 the thread 3 for insertion into the loom shed 6 formed by the upper shed warp threads 7 and by the lower shed warp threads 8.

The heavy duty fabric 10, 10' moves in the direction of the arrow 10*a* and the beat up edge is shown at 9. The slay or reed beam 11 carries a conventional reed 12. According to the invention the reed beam 11 is equipped with separation walls 14 forming compartments 15 through which the lower shed warp threads 8 can travel without interfering with the movement of the gripper assembly 1. Preferably, the compartments 15 are formed on a separate sectional slay member 13 having the profile shown in the sectional view of FIG. 1 and also of FIG. 2*a*. For this purpose the separation walls 14 are secured with the proper spacings from one another to the separate slay member 13 as will be described in more detail below.

FIG. 2*a* illustrates a situation in which the warp threads 8 forming the lower shed are more numerous than the warp threads 7 forming the upper shed. This is the situation which interfered with the proper movement of the gripper assembly 1 only shown symbolically in FIG. 2*a*. The separation walls 14 are so dimensioned that all the lower warp threads 8 can be accommodated in the compartments 15 formed between the separation walls 14 as best seen in FIG. 2*b*. As mentioned, the slay member 13 is separable from the slay or reed beam 11 by loosening screws 13*a* which preferably pass through the reed 12 into a mounting molding 13*b* for clamping the elements 12 and 13 to the reed beam 11.

FIG. 2*b* shows that the separation walls 14 have an upper edge 16. All the upper edges 16 are horizontally aligned with the guide surface 5*a* so that the edges 16 form an extension of the guide surface 5*a* on which the gripper assembly 1 is firmly supported when it moves into and out of the loom shed 6. Depending on the spacing between neighboring separation walls 16, the resulting compartments 15 for guiding the lower warp threads 8 have a longitudinal width W1 as shown in FIG. 2*b*. Preferably, the width W1 is uniform along the entire length of the reed beam 11.

The dimensions of the compartments 15 are selected in accordance with the thickness of the fabric to be woven which in turn depends on the thickness of the warp threads 8. These dimensions may be varied by selecting different sets of separation walls 14 having different heights H1, H2, H3 above the slay sole 13*c* formed by the slay member 13. The position of the slay member 13 relative to the reed beam 11 will be so selected so that the edges 16 of the separation walls 14 will be aligned with the guide surface 5*a*, regardless of the height of the separation walls 14.

The separation walls 14 are secured to the slay member 13 by inserting the lower ends of the separation walls 14 into grooves 14*a* in the slay member 13. A horizontal bore 13*d* passes entirely through the slay member 13 and a locking rod 17 passes through this bore 13*d* and through respective holes 18 in the lower ends of the separation walls 14. By withdrawing the locking rod 17 all separation walls 14 can be removed from the grooves 14*a*. Similarly, by passing the locking rod 17 through each hole 18 in each separation wall 14, these walls are firmly locked in place. The total number of separation walls 14 will depend on the spacing W1 or W2 required to assure a proper guiding by the top edges 16 of these separation walls. The spacing between neighboring separation walls may be uniform, as mentioned above, however it does not need to be uniform. For example, it may be desirable to reduce the spacing between neighboring separation walls 14 in the center of the loom where the weft threads are taken over by the pull-out gripper from the insertion gripper. In this way it is possible to properly support the two gripper rods, especially their heads at the return point where the inserted weft thread is released by the inserting gripper head and taken over by the withdrawing gripper head.

FIG. 3 shows a larger spacing W2 which is achieved by omitting, for example, every other separation wall 14. The respective groove 14*a* is then filled by a filler member 14*b* which is held in place by the locking rod 17 just as the separation walls 14 are locked in place.

FIGS. 2*b* and 3 show that the lower warp threads 8 are completely received in the respective compartments 15.

FIG. 1 shows at 10' the formation of the heavy duty fabric, while at 10 only a schematic fabric is shown. In any event, the compartments 15 will be dimensioned to accomodate the lower warp threads 8 in such a manner that the upper edges 16 of the separation walls 14 can form an extension of the guide surface 5*a* for the gripper rods to thereby properly guide each gripper assembly into and out of the loom shed.

Although the invention has been described with reference to specific example embodiments it will be appreciated that it is intended to cover all modifications and equivalents within the scope of the appended claims.

What I claim is:

1. A reed beam construction for a gripper loom on which a shed is formed by lower shed warp threads and upper shed warp threads for weaving heavy duty fabrics, comprising a reed beam for supporting a reed, and separation walls disposed along said reed beam for forming a plurality of separate upwardly open compartments on said reed beam, said separation walls extending parallel to said lower shed warp threads, said compartments having such a depth and width between said separation walls that all of said lower shed warp threads pass through said compartments, said construction further comprising a slay or reed beam section separable from said reed beam, means for securing said separable reed beam section to said reed beam, a plurality of parallel grooves in said reed beam section, said separation walls having lower edges rigidly secured in said parallel grooves, so that each parallel groove holds one of said separation walls.

2. The reed beam construction of claim 1, wherein said reed beam section is a profiled sectional member resting on a respectively profiled shoulder of said reed beam.

3. The reed beam construction of claim 1, wherein said separation walls have upper edges horizontally aligned with one another and with a gripper head guide, so that a gripper head is guided along said upper separation wall edges.

4. The reed beam construction of claim 1, further comprising means for securing said separation walls to said reed beam, said securing means comprising a plurality of parallel grooves in said reed beam, a bore passing longitudinally through said reed beam in a position so as to intersect with each of said parallel grooves, each of said separation walls having a lower edge received in a respective one of said parallel grooves, each separation wall further having a locking hole aligned with said bore in said reed beam, and a locking rod passing through said bore and through said locking hole in each separation wall for locking each separation wall in its respective groove.

5. The reed beam construction of claim 5, wherein said reed beam comprises a separable reed beam section, said parallel grooves and said bore being arranged in said separable reed beam section, and means for securing said separable reed beam section to said reed beam.

6. The reed beam construction of claim 5, further comprising groove filler elements fitting into said grooves to be flush with a surface of said reed beam, whereby replacement of a number of said separation walls by said groove filler elements widens the spacing between neighboring separation walls.

7. The reed beam of claim 5, further comprising exchangeable sets of said separation walls, each set comprising separation walls having a vertical height that differs from the vertical height of other sets so that the depth of said compartments perpendicular to the length of the reed beam can be changed by exchanging one set of separation walls against another set of separation walls.

* * * * *

UNITED STATES PATENT AND TRADEMARK OFFICE

CERTIFICATE OF CORRECTION

PATENT NO. : 5,088,525

DATED : February 18, 1992

INVENTOR(S) : Ewald Zimmermann

It is certified that error appears in the above-identified patent and that said Letters Patent is hereby corrected as shown below:

Claim 5, line 1, (column 4) line 64, replace claim "5" by insert --claim 4--.

Signed and Sealed this

Fourth Day of May, 1993

*Attest:*

Michael K. Kirk

MICHAEL K. KIRK

*Attesting Officer*

*Acting Commissioner of Patents and Trademarks*